US008104237B2

(12) United States Patent
Esemann et al.

(10) Patent No.: US 8,104,237 B2
(45) Date of Patent: Jan. 31, 2012

(54) INSULATING GLASS ELEMENT

(75) Inventors: Hauke Esemann, Wörrstadt (DE); Wolfgang Schmidbauer, Mainz (DE); Torsten Gabelmann, Wiesbaden (DE); Claudia Stolz, Ingelheim (DE)

(73) Assignee: Schott AG, Mainz (DE)

( * ) Notice: Subject to any disclaimer, the term of this patent is extended or adjusted under 35 U.S.C. 154(b) by 178 days.

(21) Appl. No.: 12/454,710

(22) Filed: May 21, 2009

(65) Prior Publication Data

US 2009/0293381 A1 Dec. 3, 2009

(30) Foreign Application Priority Data

May 27, 2008 (DE) ..... 10 2008 025 412

(51) Int. Cl.
*F23M 7/00* (2006.01)

(52) U.S. Cl. ..... 52/171.1; 52/786.1; 52/786.11; 52/786.13; 52/787.11; 126/200

(58) Field of Classification Search ..... 52/784.1, 52/783.1, 786.1, 786.11, 786.13, 787.11, 52/788.1, 171.3, 784.11; 126/200
See application file for complete search history.

(56) References Cited

U.S. PATENT DOCUMENTS 4,058,107 A 11/1977 Edwards
4,198,796 A * 4/1980 Foster ..... 52/203
4,454,427 A * 6/1984 Sosnowski et al. ..... 290/2
H975 H * 11/1991 Selkowitz et al. ..... 52/172
5,209,034 A * 5/1993 Box et al. ..... 52/171.3
5,493,821 A * 2/1996 Cohen et al. ..... 52/171.3
5,601,677 A * 2/1997 Leopold ..... 156/109
5,878,538 A * 3/1999 Rossini ..... 52/171.3
6,105,336 A * 8/2000 Katoh et al. ..... 52/786.13
6,235,356 B1 * 5/2001 Shibuya et al. ..... 428/34
6,553,728 B1 * 4/2003 Zurn ..... 52/171.3
6,581,341 B1 * 6/2003 Baratuci et al. ..... 52/204.5
6,601,575 B2 * 8/2003 Gros et al. ..... 126/200
6,715,431 B1 * 4/2004 Maejima ..... 110/233
2004/0011348 A1 1/2004 Bachinski et al.
2005/0139209 A1 6/2005 Deng

FOREIGN PATENT DOCUMENTS

GB 1087296 10/1967

* cited by examiner

*Primary Examiner* — Brian Glessner
*Assistant Examiner* — Beth Stephan
(74) *Attorney, Agent, or Firm* — Pauley Petersen & Erickson

(57) ABSTRACT

An insulating glass element for the at least partial delimitation of a combustion chamber, having at least two viewing panes, which have at least some areas a transparent glass or ceramic-glass material and are arranged spaced apart from each other while leaving an air chamber, and wherein a viewing area is created at least in parts of the air chamber. The two viewing panes are connected with each other by a temperature-resistant adhesive, and the adhesive encloses a viewing area of the viewing panes all around, or a spacing element, which runs around them at least partially, is connected with the two viewing panes in a material-to-material manner, preferably by a glued connection.

12 Claims, 2 Drawing Sheets

INSULATING GLASS ELEMENT

BACKGROUND OF THE INVENTION

1. Field of the Invention

This invention relates to an insulating glass element for at least partial delimitation of a combustion chamber, having at least two viewing panes, which include in at least some areas a transparent glass or ceramic-glass material and which are spaced apart from each other while leaving an air chamber, and a viewing area is created at least in parts of the air chamber.

2. Discussion of Related Art

Insulating glass elements are used in connection with space heating devices, for example fireplaces, and other combustion installations, for example garbage-burning installations, pyrolysis furnaces, crematoria and the like, or also in ovens, for example as the oven door. They permit the user to view the combustion chamber. In the process, an insulating effect is achieved by the multi-pane construction.

A door for an oven is known from United Kingdom Patent Reference GB 1,087,296. It has two viewing panes, which extend parallel with respect to each other and are kept apart by spacing elements. Internal air can circulate in the air chamber thus formed and is heated while passing through the air chamber and aids in heating the chamber.

A door system is described in U.S. Pat. No. 4,058,107, which also has two viewing panes with spacing devices. The door frame contains a number of ventilating openings, both in the lower as well as the upper holding strip, so that the air heated in the space between the panes can move by convection and supply the operating space with warm air.

United States Patent Reference 2004 00 11 348 A1 describes a double-pane construction, which also defines a space between both viewing panes. However, the viewing panes are not arranged parallel to each other, but are constructed so that the gap at the upper end of the viewing panes is reduced. A blower additionally blows either room air or fresh air into the space between the panes, in particular for cooling the inner viewing panes, to achieve a temperature load under which prestressed soda-lime glass can be safely employed.

Finally, United States Patent Reference 2005/01 39 209 A2 goes still one step further, as described in United States Patent Reference 2004 00 11 348, where air is moved by convection, either without being forced, or with the aid of a blower, between the viewing panes. The outer viewing pane is replaced by a plastic pane. Electrical energy is required for operating the blower, which worsens the energy balance.

With known insulating glass elements, dust, and depending on the respective construction, soot, collects between the viewing panes, so that regular cleaning is required. Thus, respectively one of the viewing panes would have to be removably integrated in a holder. With only a small cost outlay, this is not possible with the known systems. Also, this requires an elaborate frame structure for the insulating glass element. In case of flare-ups in the combustion chamber, the viewing panes are subjected to large stresses. The forces thus created in case of a flare-up are transmitted via the spacing elements from the inner to the outer viewing pane. During this, pressure peaks are generated in the area of the spacing elements. In order to reduce these safely, the individual viewing panes must have sufficient strength, and therefore sufficient thickness.

One disadvantage regarding emission characteristics of the combustion location can be noted in connection with the known insulating glass elements. The viewing pane facing the combustion location is cooled by the circulating air. The generation of nitric oxide, for example, is aided at the inside of the cooled inner pane, which contributes to the worsening of the waste gas characteristics. Also, the combustion temperature is limited by cooling the inner pane, which leads to an increase in fine dust emissions.

SUMMARY OF THE INVENTION

It is one object of this invention to provide an insulating glass element of the type mentioned above but which contributes to improved emission characteristics of the combustion location and is easy to clean in the process.

This object is attained with two viewing panes that are connected with each other by a temperature-resistant adhesive. The adhesive encloses a viewing area of the viewing panes all around, or a spacing element, which runs around them at least partially, is connected with the two viewing panes in a material-to-material manner, preferably glued to it.

Thus, this invention can have a permanent connection of two or several viewing panes by an adhesive to form a fixed composite pane. Thus, the insulating glass element can be manipulated as a structural unit and can be simply installed in the same way as a single pane. In the process, the sealing of the insulating glass element in a surrounding frame, for example a door frame, clearly becomes simpler. It is possible to omit the otherwise required sealing layers between the individual panes which increases the options for the design of the door frame. In particular, it now can be designed with a reduced structural depth. Because the frame can be made with a reduced structural size according to this invention, savings in material and a reduction in weight also results.

Because of the gluing, the insulating glass element forms a component of great stiffness, so that it is the bearing element of a door. A frame can then possibly be omitted, in which case the hinges and locking elements are directly connected with the insulating glass element, or a frame is employed which provides a connection with the hinges and the locking elements. It is also possible to employ viewing panes of lesser thickness, which leads to further weight and material savings, along with sufficient stability.

Because the adhesive encloses the viewing area all around, a dustproof seal is formed, so that the air chamber remains permanently clean. Regular cleaning can thus be omitted.

Also, the adhesive delimits an insulating air volume in the air chamber. The emission characteristics are thus positively affected because higher combustion temperatures are created in the combustion chamber.

Another object of this invention is to provide the connection of the two viewing panes with a spacing element which is arranged in the area between the viewing panes and can be glued together with them. The spacing element and the adhesive layers again provides a dust-proof and soot-proof sealing of the air chamber. The spacing element also improves the load distribution between the pane parts, and also stiffens them.

In one embodiment of this invention, the viewing panes are glued together by an adhesive on the basis of waterglass inserted between them. This adhesive is sufficiently temperature-resistant even under large thermal loads. The adhesive can be filled, for example, with low-expansion fillers, such as quartz meal, which leads to a reduction in thermal expansion. This can be important when using zero-expansion glass-ceramic elements as the pane material in order to prevent the formation of cracks and to guarantee a long-term resistance to temperature changes.

If the cured adhesive is gas-permeable, a temperature equalization between the air chamber and the surroundings in case of temperature changes is possible. The dustproof separation of the air chamber is maintained. Gas permeability can be provided by an appropriately porous adhesive material. It is also possible to integrate a pressure-equalization element, for example a porous ceramic filter, into the adhesive layer or into the spacing element, or to assign it to the spacing element. The pressure-equalization element can form a dustproof separation.

If in one embodiment of this invention the cured adhesive is hydrophobic, it is then possible to reduce, or completely suppress, the penetration of water, in the form of a product of combustion or humidity, into the air chamber.

With an insulating glass element it is possible to achieve a clear optimization of the material, along with sufficient stability, if the viewing panes are of different thickness. The thicker viewing pane meets static requirements, which are complemented by the thinner viewing pane in a material-saving manner, and for completing the insulating glass element. Thicknesses of less than or equal to 4 mm can be realized with this construction. Defined format sizes also makes it possible to construct insulating glass elements wherein both viewing panes are of the same thickness, in particular less than or equal to 4 mm.

In another embodiment of this invention one or several viewing panes are arranged between the two outer viewing panes, and the inner viewing panes have a clearly lesser thickness than the two outer viewing panes.

The two outer panes of an insulating glass element provide sufficient stability. Each inner pane carries off no or only light mechanical loads and clearly increases the insulating effect.

BRIEF DESCRIPTION OF THE DRAWINGS

This invention is explained in view of an exemplary embodiment represented in the drawings, wherein.

DETAILED DESCRIPTION OF THE INVENTION

Figure 1:
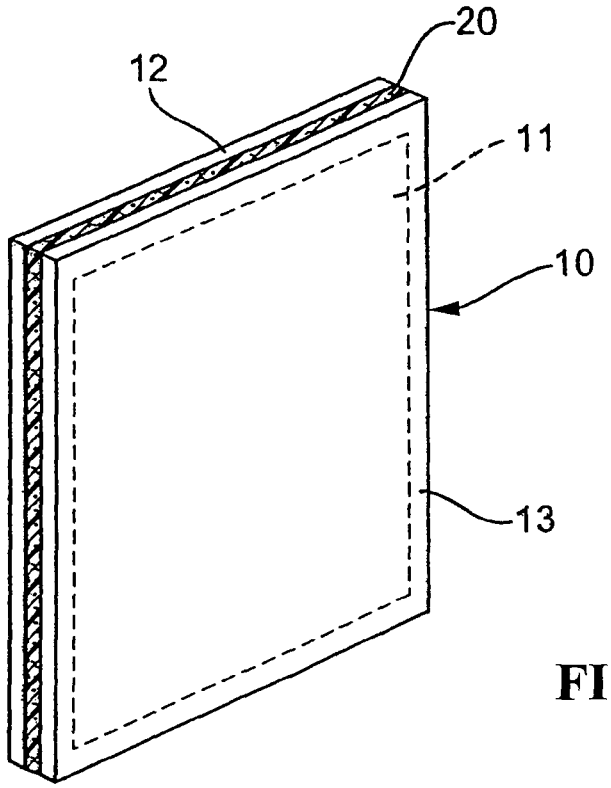
FIG. 1 shows an insulating glass element in a perspective view.
Figure 2:
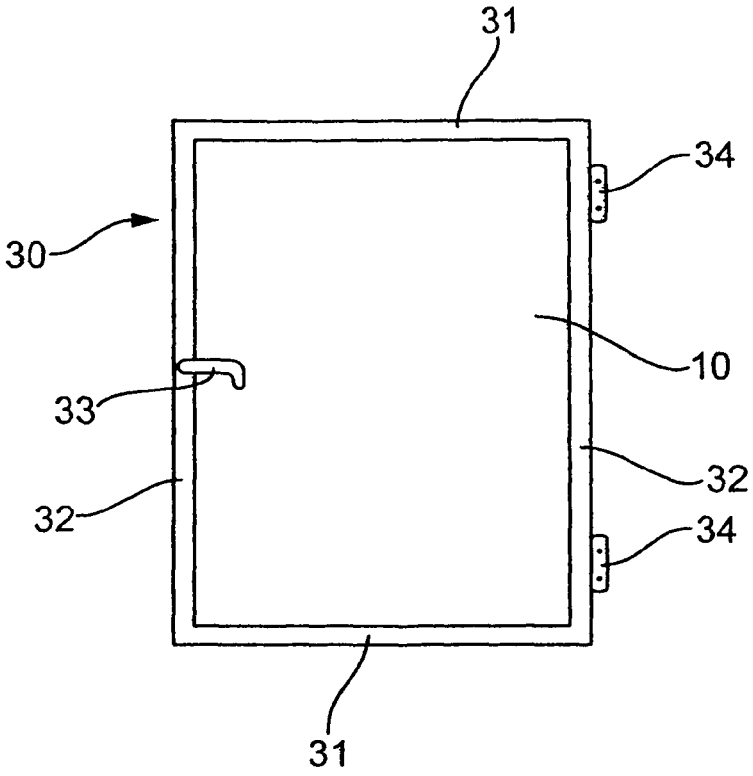
FIG. 2 shows an oven door with an insulating glass element in accordance with FIG. 1, in a front view.

An insulating glass element 10 with two viewing panes 11, 12, which are spaced apart parallel in relation to each other, is represented in FIG. 1. An air chamber is formed between the two viewing panes. The viewing panes 11, 12 can be made of a transparent glass-ceramic material, for example. An adhesive 20 is employed for connecting the two viewing panes 11, 12 and is arranged to extend around the edge 13 of the viewing panes 11, 12 in the form of an adhesive bead. The adhesive bead extends around the viewing area of the viewing panes 11, 12, through which a view on a hearth of a furnace is made possible. The adhesive 20 glues the two viewing panes 11, 12 together around their circumferences, so that the air chamber is sealed in a dustproof manner against the surroundings. The circumferential adhesive bead also makes possible an even load distribution from the one to the other viewing pane 11, 12.

The insulating glass element 10 in accordance with FIG. 1 can be completed by a door frame 30 to form a furnace door. The door frame 30 comprises four profiled frame sections 31, 32, which are connected to form a closed frame. The frame sections 31, 32 have a cover section, by which the adhesive bead of the insulating glass element 10 is covered on the outside, so that a visually pleasing design results.

On the hinge side, the vertical profiled frame sections 32 have two hinge elements 34, and a closure 33 on the catch side, for example a handle with a locking tongue.

Figure 3:
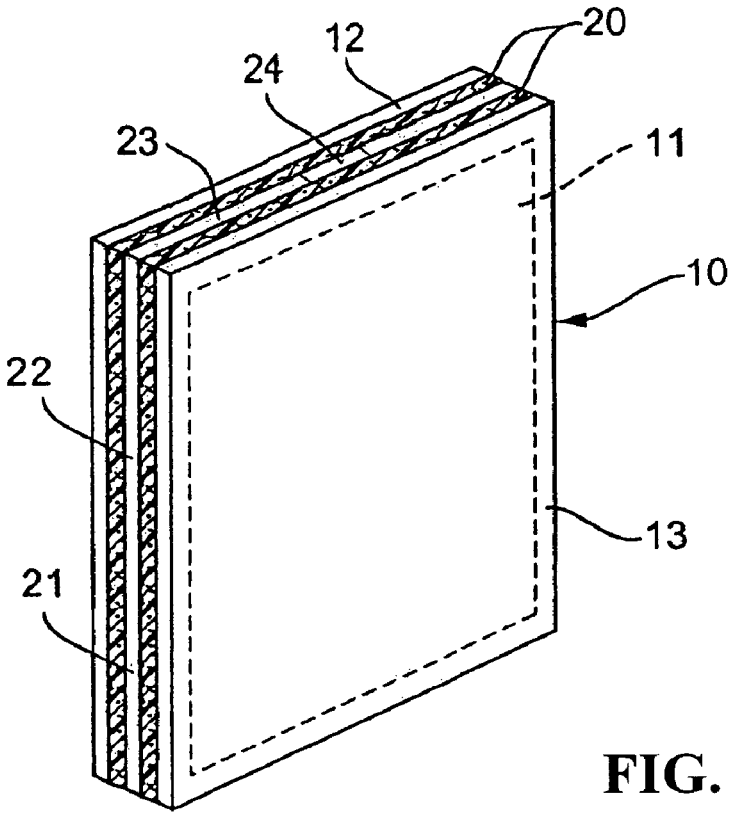
FIG. 3 shows an insulating glass element, according to an alternative embodiment of this invention, in a perspective view.

Alternatively to the adhesive bead, it is possible to use a spacing element 21, as shown in FIG. 3, for connecting the two viewing panes 11, 12, which is arranged in the form of a circumferential frame between the viewing panes 11, 12 which are parallel in relation to each other. The spacing element 21 has level contact faces on oppositely located sides, on which the viewing panes 11, 12 are placed with their facing sides and with the interposition of an adhesive layer 20. The adhesive layer 20 connects the viewing panes 11, 12 in a material-to-material manner so that an air chamber is delimited by the spacing element 21 and the viewing panes 11, 12. In order to prevent pressure differences between the surroundings and the air chamber from being created during a temperature change, a pressure equalization element 24 is assigned to the spacing element 21 and provides a pressure equalization between the surroundings and the air chamber. The pressure equalization element can be integrated into the spacing element or can interrupt its continuous shape in places. The pressure equalization element is formed by a filter, for example a porous ceramic material.

For constructing the spacing element, several, preferably four, profiled sections, such as profiled sections 22 and 23, are connected with each other, preferably glued, into an at least partially circumferential frame. Here, the profiled sections can be made of the same material as the viewing panes 11, 12.

German Patent Reference 10 2008 025 412.6-25, filed 27 May 2008, the priority document corresponding to this invention, to which a foreign priority benefit is claimed under Title 35, United States Code, Section 119, and its entire teachings are incorporated, by reference, into this specification.

What is claimed is:

1. An insulating glass element for at least partial delimitation of a combustion chamber, having at least two viewing panes (11, 12) including in at least some areas a transparent glass material or a ceramic-glass material and spaced apart from each other and forming an air chamber, and a viewing area in at least a part of the air chamber, the insulating glass element comprising:

the two viewing panes (11, 12) connected with each other by a temperature-resistant adhesive (20), and the adhesive (20) being gas-permeable when cured and extending around an entire periphery of and between the two viewing panes (11, 12) and enclosing a viewing area of the viewing panes (11, 12), or a spacing element running at least partially around the air chamber and being connected with each of the two viewing panes (11, 12) by the adhesive (20), wherein the adhesive is gas-permeable when cured and extends around an entire periphery of each side of the spacing element between the spacing element and each of the two viewing panes (11, 12).

2. The insulating glass element in accordance with claim 1, wherein the adhesive (20) comprises waterglass filled in between the viewing panes (11, 12).

3. The insulating glass element in accordance with claim 1, wherein the insulating glass element includes the spacing element, and the spacing element has support faces parallel with each other on which the viewing panes (11, 12) have facing inner sides and an interposition of an adhesive layer.

4. The insulating glass element in accordance with claim 2, wherein the cured adhesive (20) is hydrophobic.

5. The insulating glass element in accordance with claim 4, wherein at least one of the viewing panes (11, 12) has a thickness of less than or equal to 4 mm.

6. The insulating glass element in accordance with claim 1, wherein the insulating glass element the spacing element, and the spacing element is assembled from a plurality of profiled sections.

7. The insulating glass element in accordance with claim 1, wherein the insulating glass element includes the spacing element, and the spacing element and at least one of the viewing panes (11, 12) are made of a same material.

8. The insulating glass element in accordance with claim 1, wherein at least one of the viewing panes (11, 12) has a thickness of less than or equal to 4 mm.

9. The insulating glass element in accordance with claim 5, wherein the insulating glass element includes the spacing element, and the spacing element is assembled from a plurality of profiled sections.

10. The insulating glass element in accordance with claim 9, wherein the spacing element and at least one of the viewing panes (11, 12) are made of a same material.

11. The insulating glass element in accordance with claim 10, wherein the spacing element has support faces parallel with each other on which the viewing panes (11, 12) have facing inner sides and an interposition of an adhesive layer.

12. The insulating glass element in accordance with claim 1, wherein the cured adhesive (20) is hydrophobic.

* * * * *